US007267598B2

(12) United States Patent
Glickman

(10) Patent No.: US 7,267,598 B2
(45) Date of Patent: Sep. 11, 2007

(54) INTERFACINGS BETWEEN BLOCK TYPE AND ROD AND CONNECTOR TYPE CONSTRUCTION TOY SETS

(75) Inventor: Joel I. Glickman, Jupiter, FL (US)

(73) Assignee: Connector Set Limited Partnership, Hatfield, PA (US)

( * ) Notice: Subject to any disclaimer, the term of this patent is extended or adjusted under 35 U.S.C. 154(b) by 0 days.

(21) Appl. No.: 11/146,971

(22) Filed: Jun. 7, 2005

(65) Prior Publication Data

US 2006/0276100 A1 Dec. 7, 2006

(51) Int. Cl.
*A63H 33/08* (2006.01)
*A63H 33/06* (2006.01)

(52) U.S. Cl. ..... 446/124; 446/125; 446/120; 446/126

(58) Field of Classification Search ..... 446/85, 446/118–122, 124–127
See application file for complete search history.

(56) References Cited

U.S. PATENT DOCUMENTS

| | | | | | |
|---|---|---|---|---|---|
| 3,205,611 | A * | 9/1965 | Onanian | 446/89 |
| 4,744,780 | A * | 5/1988 | Volpe | 446/128 |
| D309,927 | S * | 8/1990 | Ryaa et al. | D21/500 |
| 5,061,219 | A * | 10/1991 | Glickman | 446/126 |
| 5,183,430 | A * | 2/1993 | Swann | 446/104 |
| 5,199,919 | A * | 4/1993 | Glickman | 446/126 |
| 5,238,438 | A * | 8/1993 | Glickman | 446/126 |
| 5,350,331 | A * | 9/1994 | Glickman | 446/126 |
| 5,527,201 | A * | 6/1996 | Maddock | 446/104 |
| 5,788,555 | A * | 8/1998 | Glynn | 446/124 |
| 5,964,635 | A * | 10/1999 | Krog | 446/120 |
| 6,059,631 | A * | 5/2000 | Maddock | 446/127 |
| 6,398,612 | B2 * | 6/2002 | Gudger | 446/125 |
| 6,422,909 | B2 * | 7/2002 | Clever et al. | 446/108 |
| 6,461,215 | B1 * | 10/2002 | Kunz et al. | 446/107 |
| 6,634,920 | B1 * | 10/2003 | Michaelsen | 446/128 |
| 6,645,033 | B1 * | 11/2003 | Thomsen | 446/120 |
| 6,736,691 | B1 * | 5/2004 | Bach | 446/128 |
| 2001/0003694 | A1 * | 6/2001 | Gudger | 446/85 |

* cited by examiner

*Primary Examiner*—Eugene Kim
*Assistant Examiner*—Alyssa M. Hylinski
(74) *Attorney, Agent, or Firm*—Schweitzer Cornman Gross & Bondell LLP

(57) ABSTRACT

A multi-part construction toy incorporating rod and connector elements, as well as block elements, modified in a way to accommodate the building of hybrid structures utilizing both types of building components. Specialized adapter blocks are provided with openings for receiving special adapter rods. A connector element may be attached in the usual manner to an adapter rod projecting from a block element. For existing rod and connector construction toy sets, the adapter blocks are specially dimensioned to enable multiple attachment points to be established such that complex hybrid structures can be formed. For the large existing base of block type sets, the invention provides a specially dimensioned rod and connector set, compatible with existing toy construction blocks, such that the complex hybrid structures described above can also be executed utilizing existing block elements of standard dimensions.

11 Claims, 8 Drawing Sheets

INTERFACINGS BETWEEN BLOCK TYPE AND ROD AND CONNECTOR TYPE CONSTRUCTION TOY SETS

BACKGROUND OF INVENTION

Multi-part construction toy sets are very popular among young children, and parents as well, as they allow for a wide expression of imagination in assembling structures and devices from the individual components of the construction toy set. Typically, a construction set will include specific, illustrated instructions for the assembly of one or more specific devices. However, in many if not all cases, the users will strike out on their own, to assemble the individual components in new ways to build structures and devices that they envision.

One of the popular multi-part construction toy sets is manufactured by K'NEX Industries, Inc., Hatfield, Pa., and sold under the well known "K'NEX" trademark. The K'NEX construction toy is comprised principally of individual rods and connector elements designed to accommodate a unique lateral snap-in assembly in a manner to enable large and complex structures of considerable strength and rigidity to be assembled. The K'NEX construction toy set is covered by and described in the Glickman U.S. Pat. Nos. 5,061,219, 5,137,486, 5,199,919 and 5,350,331, among others. The disclosures of those patents are incorporated herein by reference.

An older but nevertheless still popular form of multi-part construction toy is of the studded block style, such as marketed under the "Lego", "Mega Bloks", and "Duplo" trademarks. These styles of construction toys utilize hollow blocks or "bricks" of rectangular configuration provided with a plurality of cylindrical studs projecting upward from flat upper surfaces thereof. The geometry of the blocks is such that the projecting studs of one block may be inserted into, and frictionally retained by, the hollow bottom area of another block in various combinations of positions, enabling a wide variety of structures to be built on a block-on-block assembly basis. Although the construction options available using block type components is somewhat more limited than with the rod and connector system described above, the block type construction sets remain popular with children and parents because the individual components tend to be somewhat larger and are easily handled and assembled by small children.

SUMMARY OF THE INVENTION

Recognizing that both of the above described rod and connector-type construction sets and the block type construction sets have their respective advantages, the present invention seeks to provide a novel, simplified and useful approach to interfacing the two distinctly different types of construction sets, such that block components can be readily incorporated into structures made primarily of rod and connector elements of K'NEX construction sets, and rod and connector elements may likewise be easily and usefully incorporated into structures utilizing block type construction elements such as Lego, Duplo and Mega Bloks.

Preferentially, the invention seeks to provide a system in which block type assembly units may be easily incorporated into structures primarily of the rod and connector (K'NEX) type, in order to enhance and expand the building experience of individuals using primarily the rod and connector type components. In the Glickman U.S. Pat. No. 5,238,438 there is disclosed a limited form of adapter block intended to permit the joining of a K'NEX structure to a block type structure. However, the disclosed arrangement had limited capabilities and limited flexibility and thus is considered far from optimum in terms of its usefulness for the purposes intended.

As set forth in the before mentioned Glickman patents, the K'NEX type rod and connector system follows a specific geometric system, with rod elements of a progression of lengths such that a right triangle of one size is comprised of rods of a first size as the sides and a rod of the next larger length progression as the hypotenuse. This principle applies throughout the progression of rod lengths such that a rod which is a hypotenuse of one triangle may be the side of another, etc. throughout.

Currently, the K'NEX rod and connector systems are marketed in two size categories, a "standard" size, directed to both children and adults, and a larger size, directed more to younger, smaller children, which has larger and softer components, both rods and connectors. For convenience, the standard rod and connector components may hereinafter sometimes be referred to as "K'NEX" components while the larger size components, directed more specifically to small children, may be referred to as "KID K'NEX" components. Both K'NEX and KID K'NEX are registered trademarks of K'NEX Industries, Inc.

As can be appreciated, in order for a block construction system to be compatible with the K'NEX and KID K'NEX systems, the geometry of the blocks must be compatible with the geometric structure of the rod and connector set, in order to be able to be integrated therein in a meaningful way. Inasmuch as both the K'NEX and KID K'NEX construction sets have a substantial existing product base, the present invention contemplates the use of specially dimensioned blocks which, while being structurally similar to the blocks of the existing Lego, Duplo and Mega Bloks sets, will have somewhat different dimensions, in order to be fully compatible with and integratable into the standard rod and connector systems of the K'NEX and KID K'NEX sets.

As a further aspect of the invention, in order to provide a K'NEX rod and connector set that is fully compatible with the existing product base of the Lego-type blocks, for example, a new and somewhat miniaturized rod and connector system is provided, which has been sized and dimensioned in the first instance to be compatible with the large existing base of block type construction toy products.

In any of the systems described generally above, a special adapter block is provided which can be outwardly identical in its dimensions to other blocks of the system but which is provided with special recesses for the reception of adapter rod elements. In a typical block element, for example, having four pairs of upwardly projecting cylindrical studs, three separate vertical recesses, preferably but not necessarily cylindrical, are provided in spaces between the pairs of standard studs. These recesses are adapted for the reception and retention of special adapter rods that project upwardly above the top surface of the block, or alternatively downwardly below the bottom surface areas of the block as desired by the builder. The adapter rod includes an end portion which corresponds in its size, its dimensions and in its configuration to a rod end of the small, standard or large size rod and connector components, as appropriate. The end of the adapter rod is adapted for a lateral snap-fit assembly with a connector part for the rod and connector set in the usual manner. The arrangement is such that block elements and rod and connector elements may be interspersed in a wide variety of ways in a hybrid assembly, providing for greatly expanded construction possibilities for the user of a hybrid set containing both blocks and rods and connectors.

In a preferred form of the invention, each of the individual block-type building elements is encoded with an identifying indicia, such as a number or letter which is distinctive to the particular shape and size of the block. Such identifying indicia can then be referred to in the building instructions and plans associated with a toy construction set, greatly facilitating the selection of the correct size and shape of block called for by the printed instruction plan.

For a more complete understanding of the above and other features and advantages of the invention, reference should be made to the following detailed description of preferred embodiments, and to the accompanying drawings.

DESCRIPTION OF A PREFERRED EMBODIMENT

Figure 1:
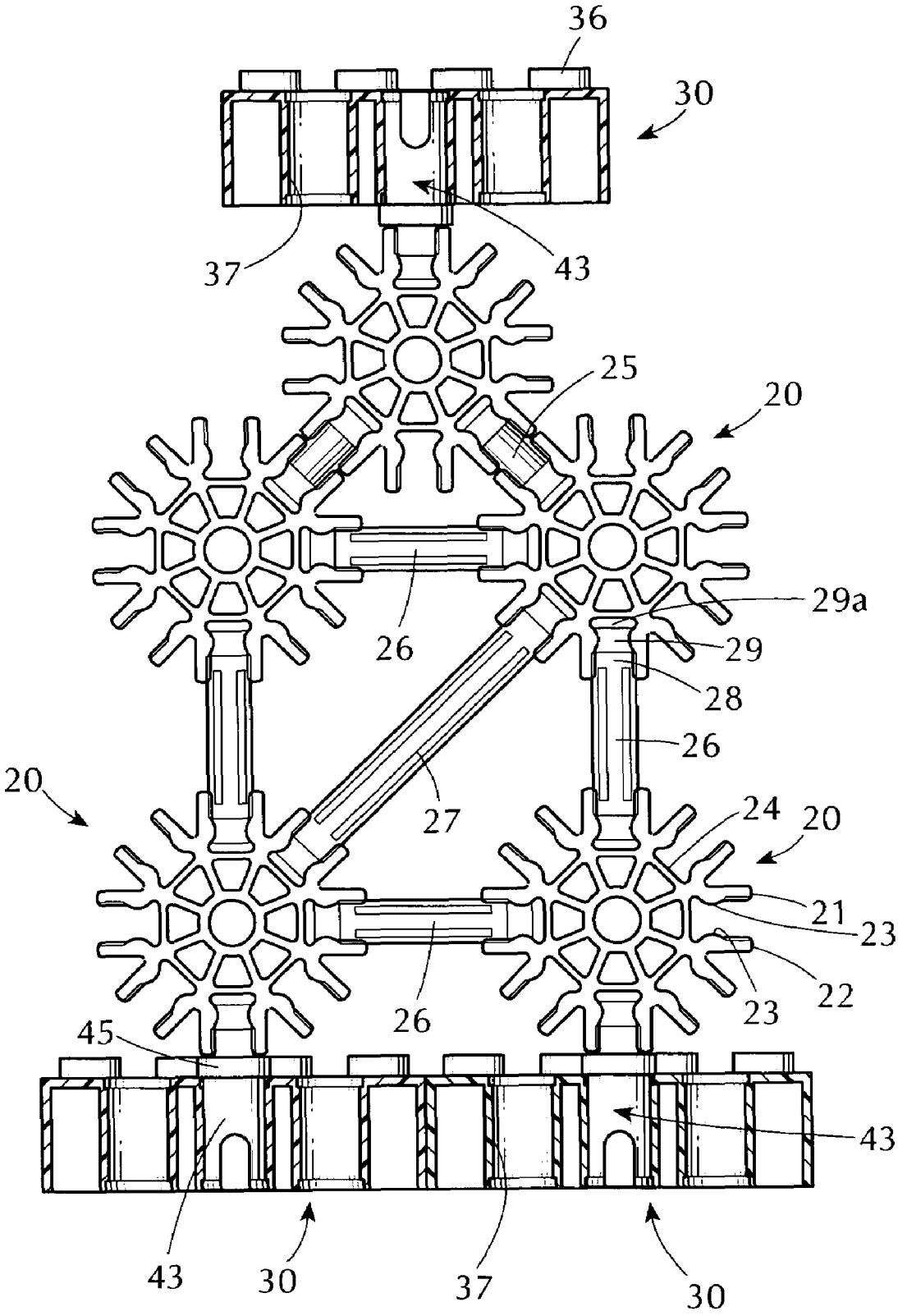
FIG. 1 is a front elevational view, partly in section, illustrating a hybrid assembly combining standard-type K'NEX components with specialized adapter blocks, and adapter rods to accommodate interfacing between the two types of construction sets.

Referring now to the drawing, and initially to FIGS. 1-6 thereof, the reference numeral 20 designates a standard form of connector found in a typical standard K'NEX construction toy set. As reflected in the before mentioned Glickman patents, the connectors 20 come in various configurations, ranging from a maximum of eight rod-receiving sockets to a minimum of one such socket. For simplification, only one type of connector, the eight-socket connector, is illustrated in FIGS. 1-6 hereof. In the connectors 20, each of the rod-engaging sockets comprises a pair of gripping arms 21, 22 mounted in cantilever fashion. Each of the gripping arms has a transversely disposed locking projection 23 spaced a short distance from its inner end wall 24. Outer portions of the gripping arms 21, 22 are formed with axially extending concave grooves (not shown).

In the illustration of FIG. 1, standard K'NEX rods are shown in three different sizes. Rods 25 are the smallest, 26 are the next larger size in progression, and the rod 27 is the next longer rod in the size progression. When the rods and connectors are joined in a manner to form right triangular structures, rods of one size can form the sides of the triangle, while a rod of the next longer size progression forms the hypotenuse. Thus, the rods and connectors may be joined to form rigid structural assemblies. In a typical K'NEX construction toy set there is a progression of at least six rod lengths, to accommodate a variety of construction possibilities.

As set forth in the before mentioned Glickman patents, the various rod elements of the construction toy set are formed at their end extremities with a cylindrical section 28, an annular groove 29, and an end flange 29*a*. A rod is assembled with a connector by a lateral, snap-in motion. When assembled, the transverse projections 23 of the connector sockets are received in and lockingly engaged with the annular grooves 29 of the rods, while the cylindrical portions 28 of the rods are gripped by concave grooves in the outer portions of the gripping arms 21, 22.

Interfacing of a K'NEX structure to a block system, such as shown in FIG. 1, is enabled by providing for compatible dimensioning of the block components with the rod and connector components, as well as providing for a unique and effective facility for joining a K'NEX connector component to a block type component. In one embodiment of the invention, the block components are specially dimensioned to be compatible with the large existing base of standard K'NEX components. In another embodiment of the invention, the rod and connector elements are specially dimensioned, in order to be compatible with the large existing base of standard Lego or Mega Bloks components. In either case, the objective is to provide simple and useful interconnections between the two types of construction systems, so that complex structures, consisting of components of block type and rod and connector type may be assembled.

Figure 2:
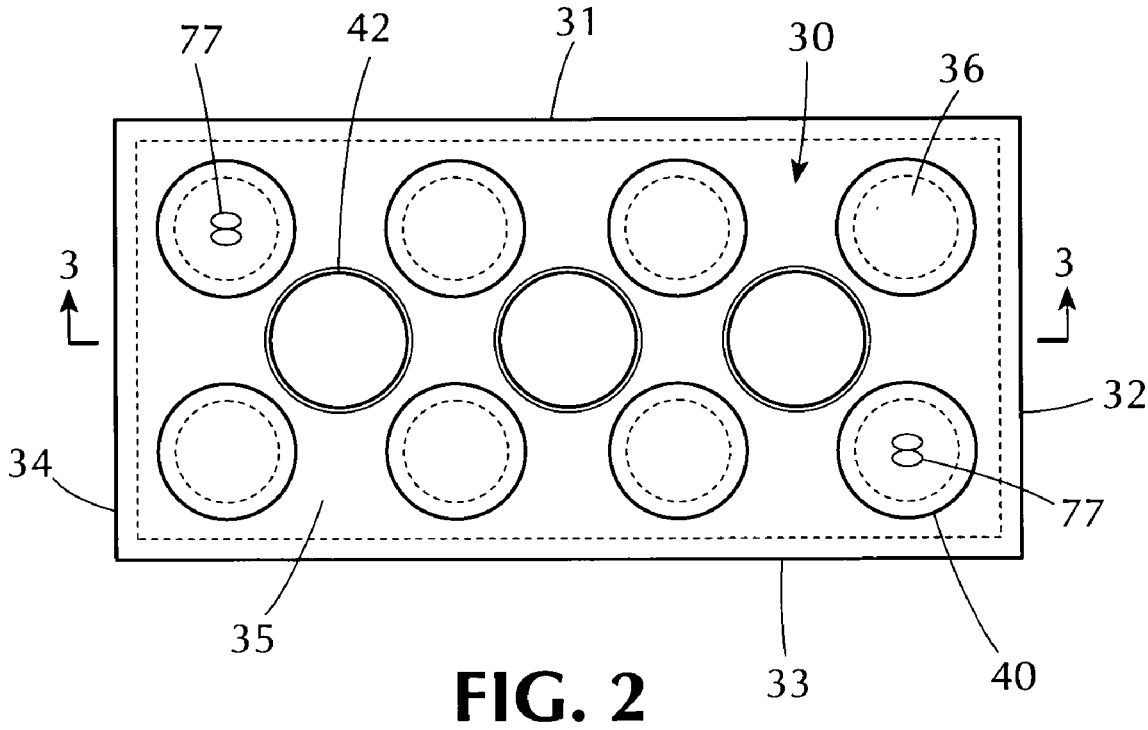
FIG. 2 is a top plan view of a specialized adapter block utilized in the assembly of FIG. 1.
Figure 3:
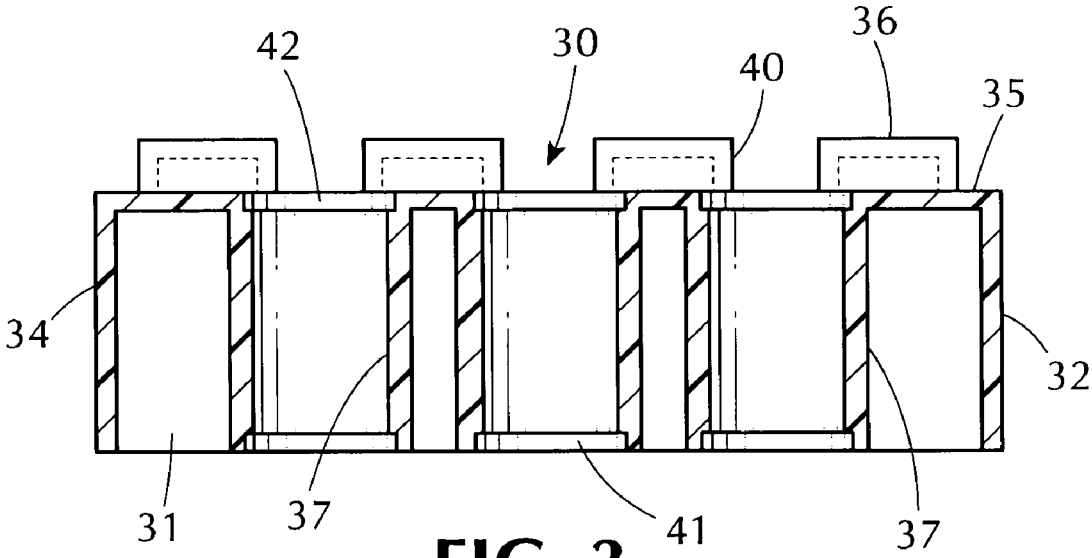
FIG. 3 is a cross sectional view as taken generally on line 3-3 of FIG. 2.
Figure 4:
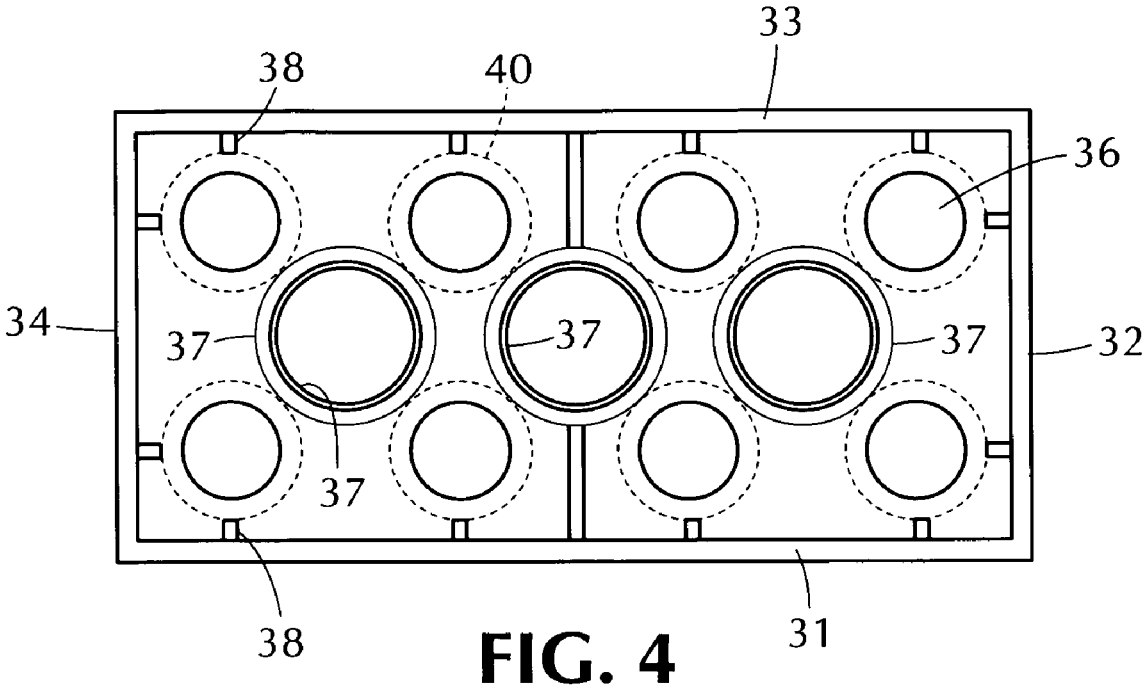
FIG. 4 is a bottom plan view of the block of FIG. 2.

In the form of the invention illustrated in FIGS. 1-6, the block type construction elements shown in FIGS. 2-4 have many characteristics of a standard Lego or Mega Bloks unit. The block 30 is of rectangular configuration and is formed with side walls 31-34 and a top wall 35. The bottom of the block 30 is generally open, as is evident in FIG. 3.

The top wall 35 of the construction block 30 is provided with eight uniformly spaced cylindrical studs 36, which project a short distance (0.116 inch) above the top wall 35 of the block. As reflected in FIG. 2, the cylindrical studs are spaced uniformly in a longitudinal direction of the rectangular block, and also in the transverse direction.

Centered in the spaces between the two rows of cylindrical studs 36 are three vertical cylindrical sockets 37, which extend downward from the top wall 35. In the illustrated embodiment, the cylindrical sockets 37 extend downward to a level a short distance (e.g., 0.006 inch) above the plane defined by lower edges of the side walls 31-34.

As reflected in FIG. 4, the internal structure of the block 30 includes a plurality of spacer ribs 38 projecting inward a short distance from each of the side walls 31-34. The projections are arranged in opposed pairs, extending along axes intersecting with the center lines of the several cylindrical studs 36. The internal geometry of the block, which is generally standardized in the Lego and Mega Bloks systems, is such that, when the cylindrical studs 36 of one block are inserted into the open side of a block above, the circumferential side wall surfaces 40 of the studs 36 will have frictional engagement with at least one projecting rib 38 and with the outer wall of at least one vertical cylindrical socket 37, such that two blocks thus assembled will be frictionally retained in the desired assembled relation. Moreover, it can be readily visualized and understood that two blocks of the type shown in FIG. 4 may be assembled in various relationships, at right angles to each other, or aligned but staggered, etc. Likewise, in a typical block type construction set, there may be blocks with more or less than eight cylindrical studs 36. However, the spacing arrangement is common to all, so that one block can always be assembled with another, whether of the same or different size.

In a particularly preferred form of the invention, the cylindrical sockets 37 are open at both ends. This differs importantly from conventional block elements, in which downwardly projecting cylindrical elements, provided for structural purposes, are closed at the top and serve only to provide an external friction surface for engagement with studs of an underlying block assembled to the block above.

To advantage, the internal wall of the cylindrical sockets 37 are recessed at each end, as indicated at 41, 42, providing a retention detent for retaining an inserted adapter rod, to be described.

Figure 5:
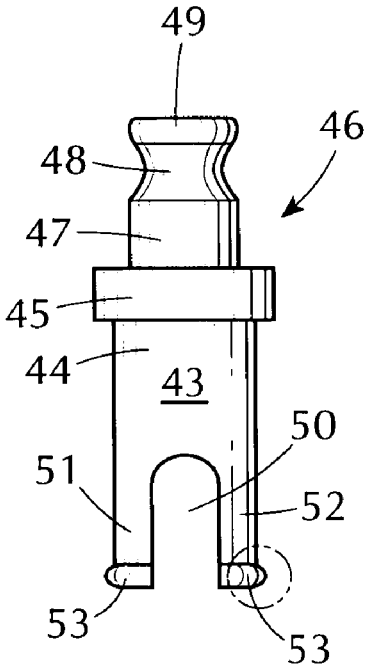
FIG. 5 is an enlarged elevational view of a special adapter rod designed for assembly with the block of FIG. 4.

With reference particularly to FIG. 5, the system of the invention includes a special form of adapter rod 43 comprising a stem portion 44, a collar flange 45 and a rod end portion 46. The rod end portion 46 includes a cylindrical portion 47, an annular groove 48 and an end flange 49 all dimensioned and configured to correspond to the rod end portions 28, 29 and 29*a* of the K'NEX rod and connector system with which the adapter rod 43 will be associated.

As shown in FIG. 5, the rod portion 44 may be formed at its lower end with a recess 50, dividing the lower end of the stem 44 into flexible portions 51, 52. At the lower extremities of the flexible portions there is provided an outwardly projecting detent flange 53.

To join the adapter block 30 with a rod and connector system, the adapter rod 43 is inserted into one of the open-ended cylindrical sockets 37, either from the top or from the bottom, as reflected in FIG. 1. The diametrical dimension of the detent flanges 53 is slightly greater than the internal diameter of the cylinder 37, such that the lower portions 51, 52 of the stem 44 flex inward to allow the stem to be inserted into the cylinder. The stem is inserted all the way into the cylinder until the collar flange 45 seats against the upper wall 35 of the block, or the lower end of the cylinder, depending upon which way the adapter rod is inserted. When the adapter rod is fully inserted into the cylinder, the detent flanges 53 engage with and are received in the detent recesses 41 or 42, as the case may be, to firmly retain the adapter rod in its assembled relation with the block element 30. Desirably, the collar flange 45 has a diameter somewhat greater than the diameter of the detent recesses 41, 42 such that, when the collar flange is seated against one end or the other of the cylinder 37, it does not enter the recess. Additionally, the collar flange has a thickness which is preferably equal to or slightly greater than the height of the studs 36 to avoid any interference between the studs 36 and a connector element joined with the adapter rod.

As is evident in FIG. 1, when an adapter rod element 43 is assembled with a mating block element 30, by inserting its stem 44 into one of the sockets 37, a standard K'NEX connector element 20 can be joined in the normal manner with the rod end portion 46 of the adapter rod 43, using a lateral, snap-in action.

In accordance with a feature of the invention, the relative dimensioning of the elements is such that an assembly of standard K'NEX components, such as shown in FIG. 1, can be connected to compatibly dimensioned block elements in a manner consistent with the normal spacing and assembly of such block elements. In the illustration of FIG. 1, the adapter blocks are arranged for compatibility with rod and connector subassemblies incorporating a specific size of rod. In principle, however, other rod sizes may be accommodated. Thus, in a rod and connector kit having rods in a progression of lengths, $L_1$, $L_2$ . . . $L_n$, from $L_1$ (shortest) to $L_n$ (longest). Thus, in a right triangular assembly of three connector elements, in which two rod elements of length $L_x$ form sides, a rod element of the next larger size (length $L_{x+1}$) forms a hypotenuse. Pursuant to the invention, adapter blocks can be provided having a length dimension equal to the distance between hub axes of two connector elements joined by a rod element of a selected length.

In the illustration of FIG. 1, for example, the length of the blocks 30 is substantially equal to the center-to-center distance between connectors 20 and rod 26.

In as much as the existing base of such construction sets of the different styles are not dimensionally compatible, a feature of the invention is to redimension the block elements to be compatible with the existing base of standard K'NEX rod and connector elements, on the one hand, and to redimension rod and connector elements, on the other hand, to provide a new size of rod and K'NEX components that are fully compatible with the existing base of block type construction sets.

In the form of the invention intended for use with the existing base of standard K'NEX components, an eight stud adapter block 30 is designed to have an overall length of slightly less than 2.089 inches, for example about 2.082 inches, and a width of slightly less than 1.045 inches, for example about 1.038 inches. The block length is intended to correspond to the 2.089 center-to-center distance between a pair of connector elements joined by a rod 26 of intermediate length, as shown in FIG. 1, while providing a minimal clearance space between adjacent blocks. The cylindrical studs 36 are spaced apart longitudinally and transversely on the surface of the upper wall 35, on spacings of 0.5223 inch. The external diameter of the studs 36 is about 0.320 inch, and their height is approximately 0.116 inch. The height of the side walls 31-34 preferably is about 0.622 inch. The cylindrical sockets 37 advantageously have an internal diameter of about 0.325 inch, while the detent recesses 41, 42 have a slightly larger diameter, preferably about 0.350 inch.

Figure 6:
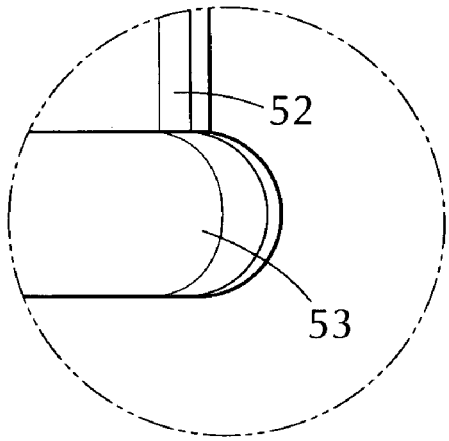
FIG. 6 is an enlarged, fragmentary view illustrating a detent flange formed on the adapter rod of FIG. 5.

In the illustrated form of the invention, the stem portion 44 of the adapter rod has a diameter to closely fit within the cylinder 37, preferably about 0.324 inch, while the outer diameter of the detent flange 53 is somewhat larger, preferably about 0.349 inch. The contours of the detent flange 53 are rounded, as shown in FIG. 6, to facilitate insertion and removal of the adapter rod. However, when the adapter rod is fully inserted, the detent flanges 53 expand into the recess 41 or 42 and serve to retain the adapter pin locked in position except against intended removal.

In a standard K'NEX rod and connector set, an intermediate rod 26 will have an overall length of about 1.293 inch, and the connectors 20, regardless of the number of rod-engaging sockets provided therein, will have a standard distance from the inner wall 24 of the socket to the center axis of the connector of about 0.398 inch. Accordingly, the center-to-center distance between two connectors joined by an intermediate rod 26 of length 1.293 inch, will be 2.089 inch, approximately equal to the length of the block 30. Thus, two connectors 20 thus assembled can be joined with two adapter rods 43 mounted in corresponding cylindrical sockets 37 of two blocks 30 placed end-to-end, as shown in FIG. 1.

Whereas adapter rods 43 shown in FIG. 1 are inserted in the central cylindrical sockets 37 of each of the adjacent blocks 30, the adapter rods may be moved one position to the left or right, as shown in FIG. 1, without changing the spacing between the adapter rods. Thus, the upper assembly portions of FIG. 1 can be shifted to the left or right relative to the pair of blocks 30 forming the base, by shifting the two adapter rods 43 either to the left or right.

In a standard K'NEX set, there are connector elements that can be joined together in a manner providing rod-engaging sockets extending in two right angularly related planes, see Glickman U.S. Pat. No. 5,350,331, FIGS. 16-22. In the structural illustration of FIG. 1, replacement of one of the lower connector elements with a composite, right angle connector element of the type mentioned would enable laterally adjacent adapter blocks 30 fitted with adapter rods 43 to be joined into the hybrid structure. Thus, the interfacing enabled by the adapter blocks and adapter rods of the invention allows for complex structures to be interfaced and complex hybrid structures comprised of blocks, rods and connectors to be assembled. It will be understood, in this connection, that numerous blocks of "standard" configuration can be incorporated in such hybrid structures. The special adapter blocks and adapter pins need be used only at the interface between blocks and rods and connectors. At the same time, however, the blocks of "standard" configuration will necessarily have the same dimensional relationships as the adapter blocks, in terms of height, length and width, etc. Where blocks are provided with a lesser or greater number of projecting cylindrical studs, the spacings will conform to the spacings used in the adapter blocks. In other words, the entire set of blocks used in the hybrid system, both adapter blocks and "standard" blocks will be built according to a common sizing and spacing system compatible with dimensioning of a standard K'NEX set.

Figure 12:
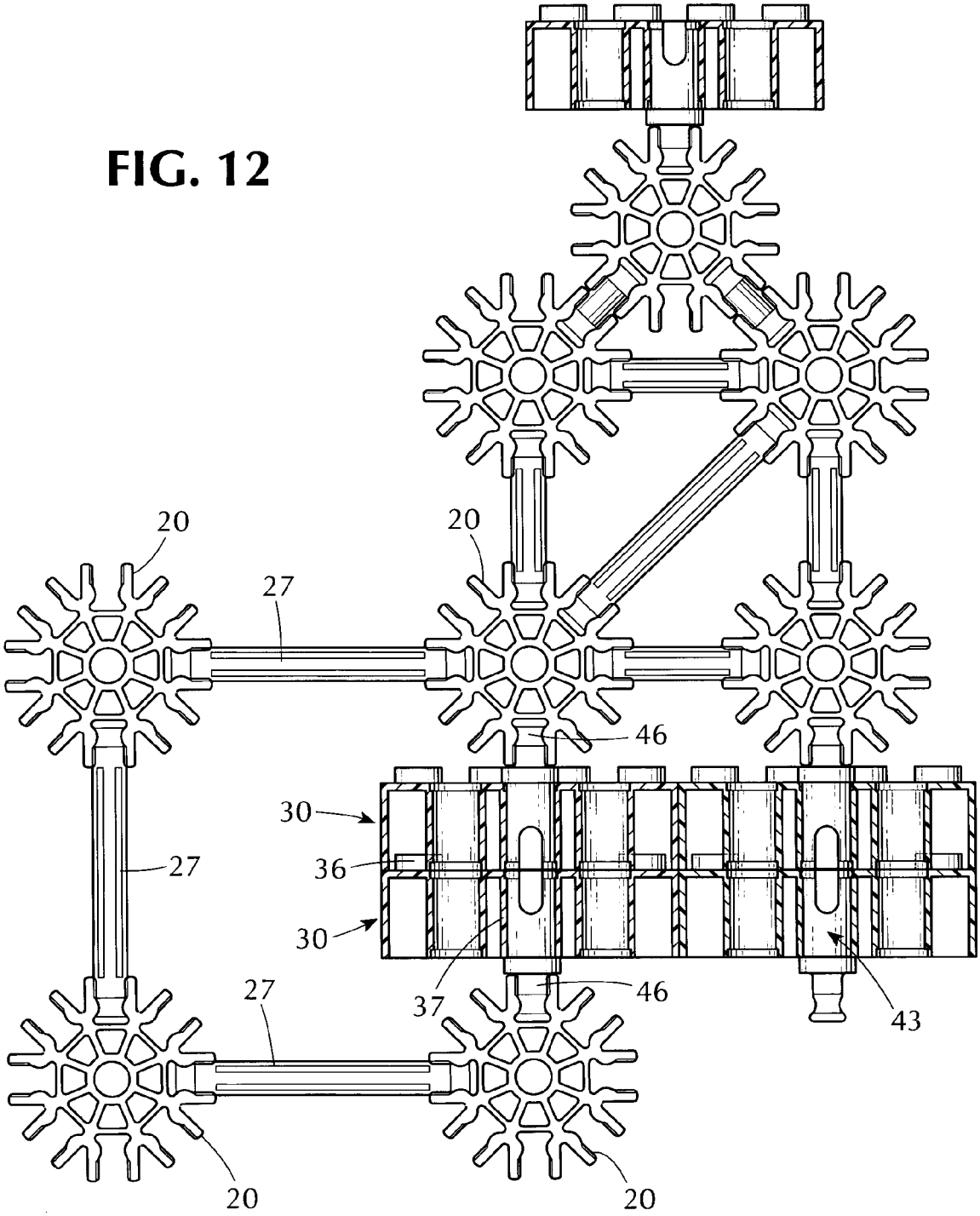
FIG. 12 is a front elevational view, similar to FIG. 1, showing an assembly including a pair of interconnected adapter blocks with adapter rods functioning as an equivalent of a rod element.

In accordance with one aspect of the invention, a vertically stacked assembly of two blocks 30, as shown in FIG. 12, enables a rod and connector structure to encompass the block assembly on both sides. Thus, as shown in FIG. 12, a pair of blocks 30 are stacked, with studs 36 of the lower block inserted into the open lower end of the upper block, in the usual manner. Adapter rods 43 are inserted into opposed pairs of cylindrical sockets 37, from the top of the upper block and the bottom of the lower block, such that the end portions 46 of the rods project in opposite directions. Pursuant to the invention, the height dimensioning of the blocks 30, and the projecting dimension of the rod ends 46 is such that the combined structure of assembled blocks and adapter rods equals the length of one of the intermediate lengths rods 27 of the rod and connector set.

Thus, in the arrangement illustrated in FIG. 12, a first pair of connectors 20 connected to adapter pins 43 projecting above and below the assembled blocks 30 are joined with horizontally extending rods 27. These in turn are joined with their respective outer ends with other connectors 20 joined by a vertical rod 27. As will be readily appreciated, this dimensional relationship provides unique advantages in a manner in which the rod and connector systems and block type construction systems may be integrated to provide complex and imaginative hybrid structures.

Figure 13:
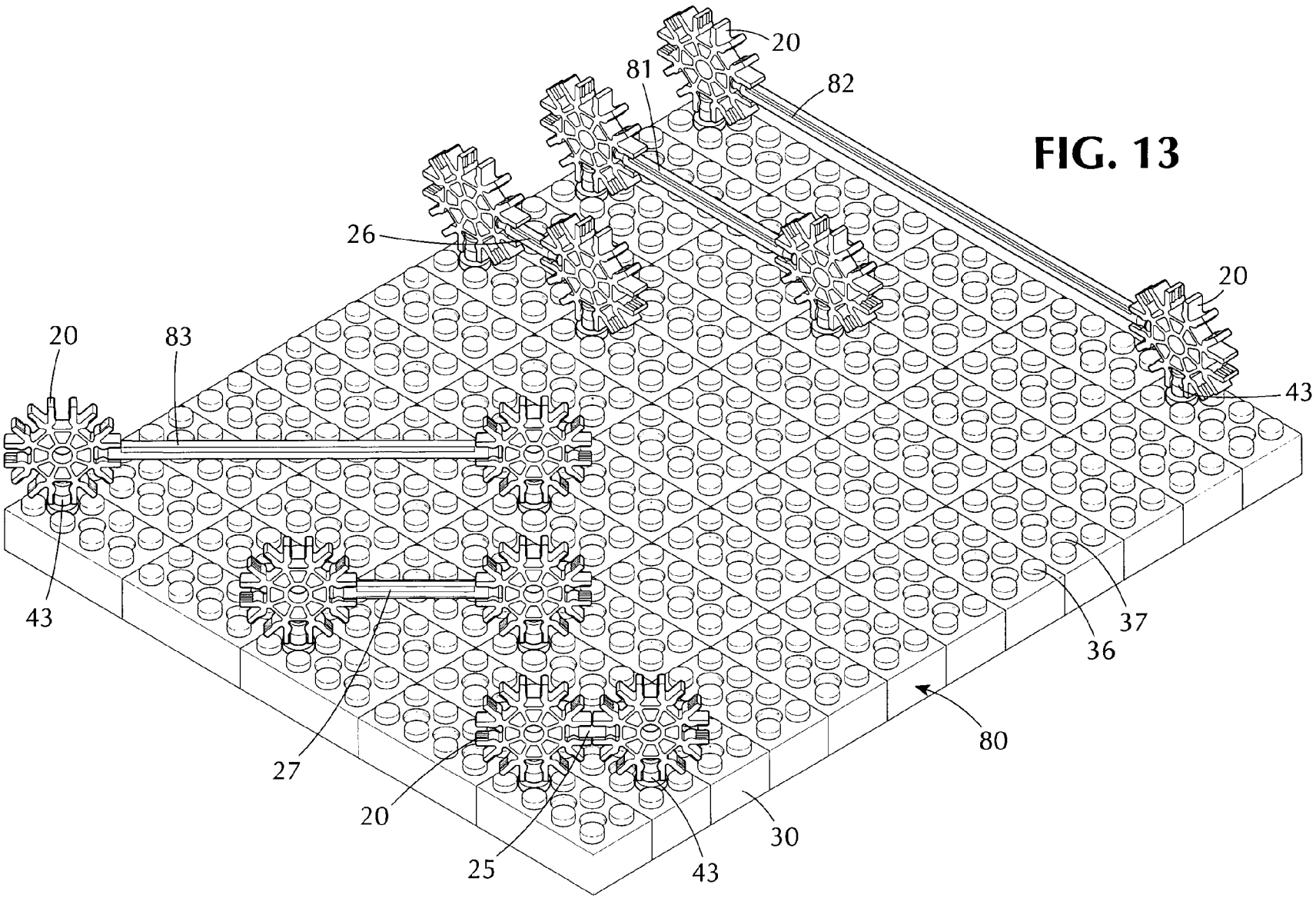
FIG. 13 is a perspective view illustrating a panel formed of a plurality of adapter blocks, illustrating the manner in which a progression of rods, from shortest to longest, can be interconnected with the block assembly to provide a basis for intricate hybrid assemblies.

With reference now to FIG. 13, there is shown an assembly of a number of adapter blocks placed side-by-side and end-to-end, forming a relatively large rectangular panel-like structure 80. In this respect, it will be understood that the panel-like structure can be made of a one-piece molding, if desired, or of an assembly of blocks of different size than illustrated. The panel-like structure 80 in any case is provided over its surface with a large plurality of uniformly spaced-apart studs 36 and with intervening cylindrical sockets 37. Whether the panel-like structure is comprised of a single molding or of a number of assembled blocks, the spacing between studs 36 and sockets 37 is the same as that described in connection with FIGS. 1-4.

In accordance with the invention, the distance from side walls 31, 33 of the blocks 30 to the center lines of sockets 37 is the same as the distance from the end walls 32, 34 to the end-most sockets 37 of a block. Additionally, the distance between adjacent sockets 37 of adjacent blocks 30 is the same, whether the blocks are placed end-to-end or side-to-side. This distance also equals the space between the end-most sockets 37 of the blocks 30. This arrangement provides for a uniform spacing of sockets both transversely and longitudinally in a panel-like structure 80. By making this spacing correspond with the length of the various rod elements, when joined with connectors at each end, it is possible to make assemblies of panels and rods wherein the rods have a rectilinear orientation on the panel-like structure 80. In FIG. 13, for example, rods 26, 81 and 82 are illustrated with connectors 20 at each end thereof mounted upon upon adapter rods 43, with the rods 26, 81, 82 extending longitudinally on the panel-like structure 80. Since the spacing of sockets 37 corresponds both longitudinally and transversely, the same rods 26, 81, 82 can be assembled in an orientation at right angles to that shown in FIG. 13.

As previously described, in the K'NEX system, when a rod of one size serves as a side of a right triangle, the rod of the next larger size can form a hypotenuse. Thus, in the illustration of FIG. 13, rods 27 and 83, which are of lengths intermediate to rods 26, 81, on the one hand and 81, 82 on the other, are of an appropriate length to extend diagonally across the panel structure 80 and be connected into sockets 37 thereof by means of connectors 20 and adapter rods 43.

Also shown in FIG. 13 is a diagonal structure consisting of a rod 25 of the smallest length joined to the panel by means of connectors 20 and adapter rods 43.

It will be evident that the arrangement of the invention provides for an exceptionally versatile arrangement for combining block-type construction toy elements with rod and connector elements to form a wide variety of hybrid structures, which can be both simplified and highly complex, according to the desires of the builder.

In the preceding description of features of the invention, it was contemplated that the rod and connector elements will derive from a standard existing size of K'NEX products, with the specialized adapter blocks dimensioned specially to correspond.

A further aspect of the invention is to provide a rod and connector system according to the principles of the standard K'NEX system, which can interface with the extensive, already existing base of Lego and Mega Bloks products for example. To this end, the rods and connectors are specially dimensioned to conform to the dimensional characteristics of existing block sets. In addition, special adapter blocks and adapter rods are provided which enable interfacing of rods and connectors to blocks in exactly the same manner as illustrated in FIGS. 1-6, 12 and 13.

For interfacing with an existing Lego system, the principles are identical to those previously described, and the appearance of the components is basically identical to that shown in FIGS. 1-6, 12 and 13, and thus will not be separately illustrated. However, the basic building blocks will be standard Lego blocks, which are differently dimensioned, and thus the adapter blocks 30 and the K'NEX-style rods and connectors are redimensioned accordingly.

A typical eight stud Lego block, for example, will have length and width dimensions of approximately 1.252 inch and 0.622 inch respectively. The eight cylindrical studs will be uniformly spaced at 0.315 inch center-to-center, a diameter of 0.1925 inch and a height of 0.70 inch. The adapter block will include three cylindrical sockets 37 which are open at the top and bottom and advantageously are provided with detent recesses 41, 42. The cylindrical sockets are spaced apart center-to-center at 0.315, which is the same spacing as between adjacent studs 36. The sockets 37 are adapted to receive the adapter rods 43, which are identical in principle to those used with the previously described standard K'NEX set, but are redimensioned to a somewhat smaller size for the somewhat smaller standard size of the Lego block. The sockets 37, for example, will have an inside diameter of 0.196 inch, and the diameter of the stem portion 44 of the adapter rod advantageously is about 0.195 inch.

All of the components of the K'NEX set are "downsized to enable assemblies, such as shown in FIGS. 1, 12 and 13 of the drawing, to be constructed using standard Lego blocks. To this end, the respective lengths of the rod elements 25, 26, 27 will be redimensioned to 0.411 inch, 0.78 inch and 1.302 inch respectively. Larger rods of the progression will be correspondingly "downsized" relative to the standard K'NEX components in accordance with established size progressions for such components. All of the connector elements are correspondingly reduced in size, such that the distance from the center axis of a connector to the end wall 24 of its rod-engaging sockets is reduced to 0.240 inch. Pursuant hereto, an entire "Micro-K'NEX" building set is provided, accompanied with adapter blocks 30 corresponding in all respects of size and configuration to standard Lego blocks, for example, that are provided with socket openings for the reception of the special adapter rods, which enable the useful interfacing of K'NEX and Lego components to form complex hybrid structures.

In the embodiment of the invention shown in FIGS. 7-11, a system of blocks and adapter blocks is provided for interfacing with a standard KID K'NEX system, utilizing the existing installed base of KID K'NEX components. Components of the KID K'NEX system are similar in many ways to, but specifically different from standard K'NEX components. The KID K'NEX system is described in considerable detail in U.S. Pat. Nos. 6,674,474 and 6,843,700, the disclosures of which are incorporated herein by reference.

Figure 7:
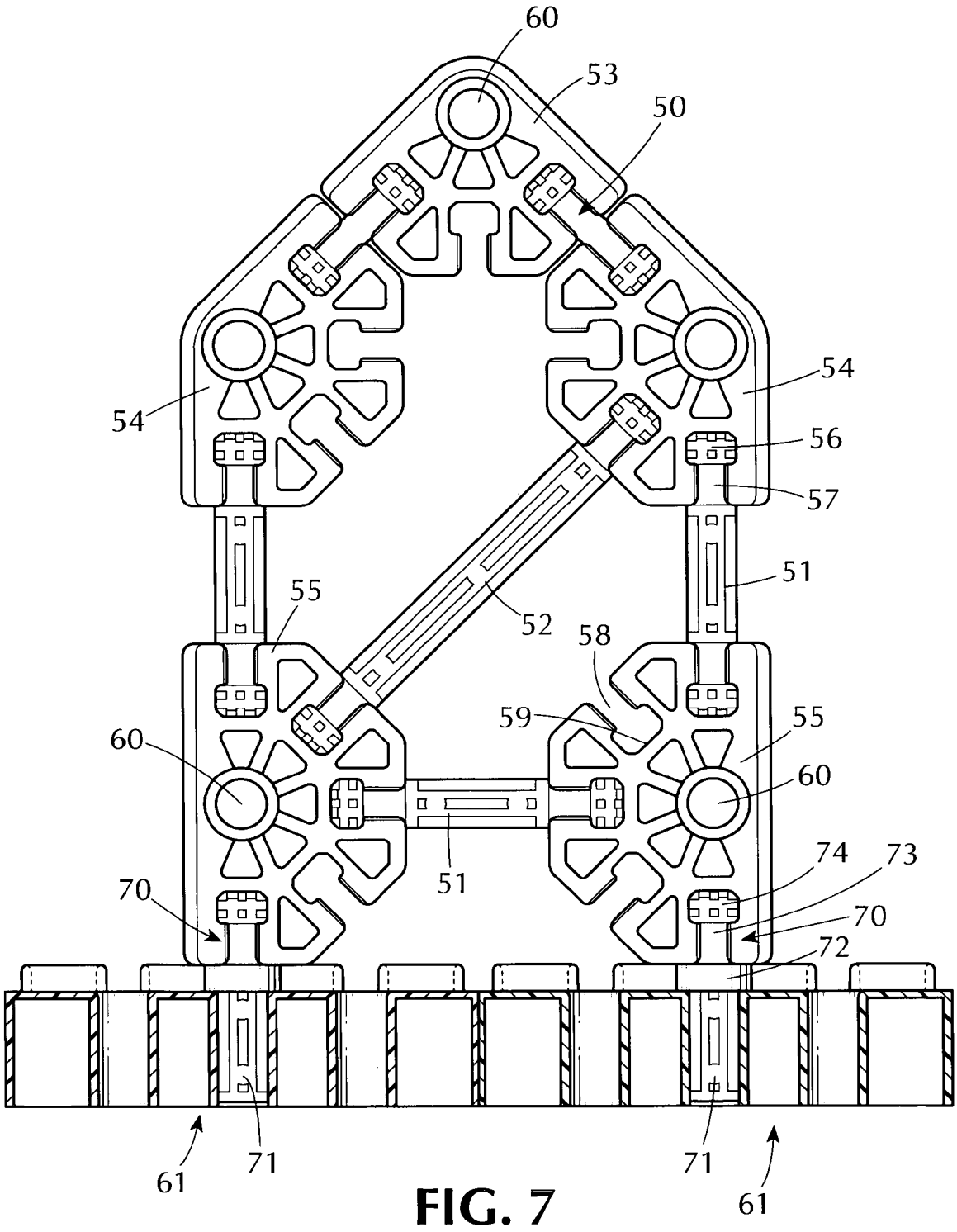
FIG. 7 is an elevational view of a hybrid assembly combining block elements with rod and connector elements of a style used in KID K'NEX sets.
Figure 8:
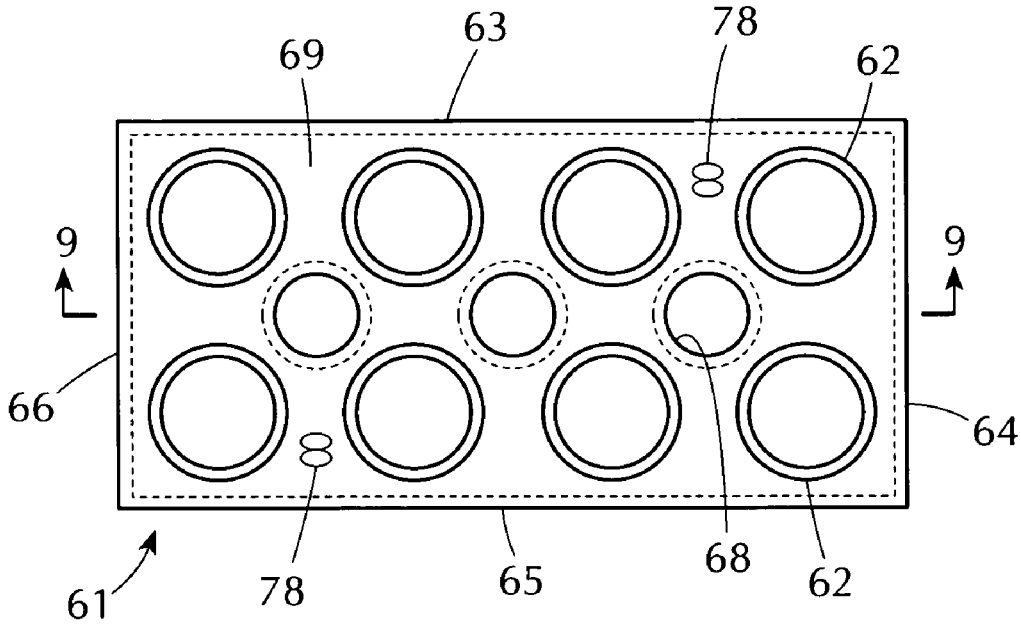
FIG. 8 is a top plan view of an adapter block utilized in the hybrid assembly of FIG. 7.
Figure 9:
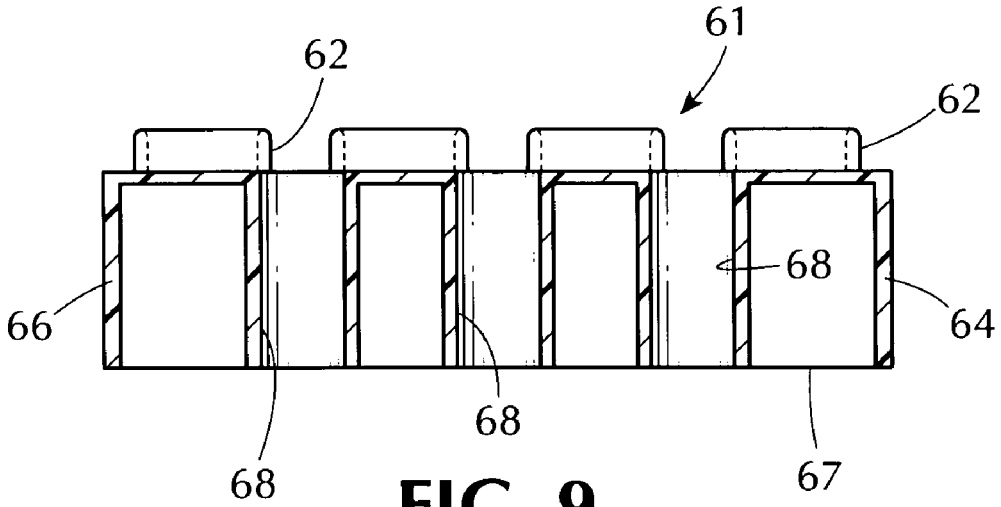
FIG. 9 is a cross sectional view as taken generally on line 9-9 of FIG. 8.
Figure 10:
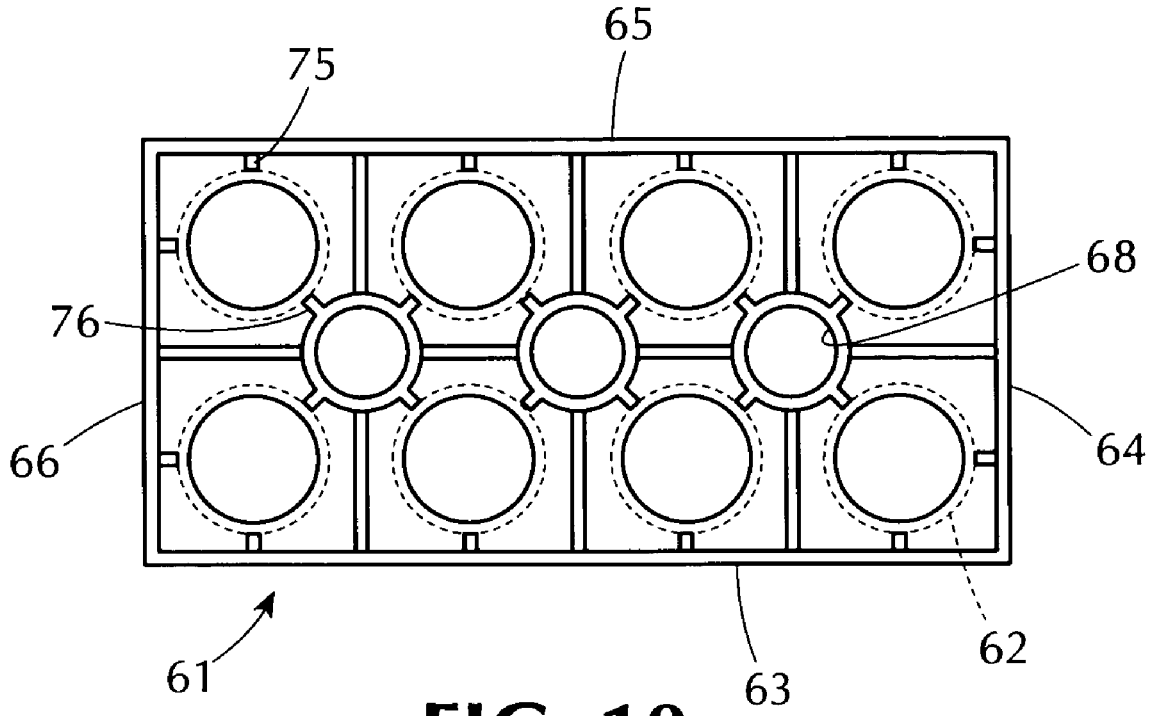
FIG. 10 is a bottom plan view of the adapter block of FIG. 8.
Figure 11:
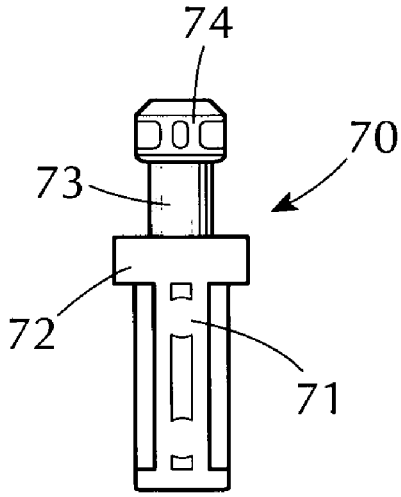
FIG. 11 is an elevational view of a special adapter rod designed for assembly with the adapter block of FIG. 8.

In the illustrated KID K'NEX system, there are a series of rods 50, 51, 52 of progressively graduated lengths, cooperating with connector elements 53, 54, 55 to form the illustrative structure of FIG. 7. Similar to the standard K'NEX set principles, the length of progression of the rods 50-52 (and larger) is such that each next-larger length rod can serve as the hypotenuse for a right triangle structure, for which the next-smaller length rods serve as opposite sides.

In the KID K'NEX system, the connector elements advantageously are formed of a soft and pliable plastic material, and grip the rods only by their end flanges 56 and neck portions 57 but do not grip the body of the rod beyond the neck portion thereof. The connector elements are formed with various numbers of rod-engaging sockets 58, from as many as eight to as few as one. Typically, the sockets are spaced angularly by 45 degrees, or a multiple thereof. All of the connector elements, regardless of the number of sockets 58 provided therein, have a standard distance from the center axis thereof to an inner end wall surface of a rod-receiving socket. For standard size components, this distance is approximately 0.670 inch.

In the structure illustrated in FIG. 7, the center-to-center distance between the axes of hub openings 60 of the connectors 55, joined by a rod of 2.199 inch length, is 3.540 inch. Accordingly, in order to provide interfacing with the standard KID K'NEX system, adapter blocks (as well as any blocks not having the interfacing features) are formed of a length of 3.540 inch, equal to the center-to-center distance between hubs 60 of the connectors 55. The width of the block is one half of its length, or 1.770 inch.

In principle, the adapter blocks are functionally similar to the blocks 30 previously described, being formed with eight cylindrical studs 62, uniformly spaced apart lengthwise and widthwise at center-to-center distances of 0.885 inch. The studs 62 can have a height of about 0.200 inch. In the illustrated example, the studs are open at the top, whereas the smaller studs of the blocks 30 previously described typically are closed. The stud diameter in the illustrated example of FIGS. 7-11 is 0.625 inch.

In the form of the invention shown in FIGS. 7-11, the adapter block 61 includes side walls 63, 64, 65, 66 having a height of about 0.875 inch, with the bottom edges defining a bottom plane 67. Three cylindrical sockets 68 extend downward from a flat top wall 69, usually terminating slightly above the bottom plane 67. The sockets 68 are open at both ends and are spaced uniformly among the eight cylindrical studs 62. In the system shown, in which the studs 62 are spaced apart longitudinally and transversely at 0.885 inch center-to-center, the cylinders 68 are equally spaced apart at 0.885 on center and positioned symmetrically in relation to the studs 62.

Special adapter rods 70 (FIG. 11) are provided for association with the adapter blocks 61. The adapter rod includes a stem portion 71, a collar flange 72, a neck portion 73 and an end flange 74. The neck portion 73 and end flange 74 correspond in size and shape to the neck portion 57 and end flange 56 of the regular KID K'NEX rod elements 50-52.

As reflected in FIG. 7, the stem portions 71 of the adapter rod 70 are inserted into the open-ended tubular cylinders 68, from either end, depending on the intentions of the builder. The adapter rod is inserted until the collar flange 72 is seated against the end of the cylinder, as shown in FIG. 7. The thickness of the collar flange 72 is preferably equal to the height of the cylindrical studs 62, such that the outer peripheral areas of the connectors 55, immediately adjacent to the open ends of the sockets 58, do not interfere with the studs 62. Where the thickness of the collar flange 72 exactly equals the height of the studs 62, upper end portions of the studs may support and add stability to a connector element engaged with the associated adapter rod 70. Suitable detent means (not shown) may be employed to temporarily secure the adapter rods 70 in the cylinders 68.

A hybrid construction toy kit incorporating the principles illustrated in FIGS. 7-11 typically will include standard KID K'NEX rods, connectors, etc., as well as building blocks characteristic of Lego, Mega Bloks or Duplo blocks, for example, dimensioned as aforesaid to provide spacings compatible with the standard dimensions of existing KID K'NEX systems. The block elements can be of various sizes, for example, four studs, eight studs and in some cases a greater number. The blocks are designed in accordance with known principles, such that the cylindrical studs 62 of one block can be received in the open bottom area of a block above. The arrangement is such that there is frictional engagement between the cylindrical studs of the lower block and inner surfaces of the block above. Typically, vertical ribs 75, 76 are provided to assure a proper frictional engagement, such that the blocks, when assembled, are effectively retained in the assembled relation.

In a complete system, all or most of the blocks may be constructed in the manner of the adapter block 61, including the open-ended cylindrical sockets 68, such that any block is capable of receiving an adapter pin. If desired, however, the block inventory may be made up of blocks of standard configuration and special adapter blocks of the type shown in FIG. 8.

To particular advantage, the various block elements utilized in connection with the present invention, as well as for block-type construction sets generally, are marked a permanent indicia to identify the characteristics of the block. Each different type of block is provided with a separate characterizing indicia, such as a number of letter. Construction diagrams for assembling structures using such blocks can identify the blocks by such characterizing indicia, making it easy and virtually foolproof for the builder to select the proper block from a mixed inventory, without having to compare the shape and size of the block visually with the illustration of the plan. By way of example, in the block shown in FIG. 2, the characterizing indicia 77 is in the form of a number imprinted on the top surface of the studs 36. In the illustration of FIG. 2, some or all of the studs bear the numeral eight, which coincidentally but not necessarily corresponds with the number of studs. Each differently shaped and/or sized block of a set is provided with an individually distinctive indicia 77. When the building plans for the set call for "block No. 8", the builder can simply pick up a block bearing the number eight and will have complete assurance that he or she has the correct block for the indicated assembly. In the form of the invention shown in FIG. 8, where the studs 62 are open cylinders and have no top surface, the identifying indicia 78 can be imprinted on the top surface of the block. The indicia may also be provided on any or all of the side walls, as desired. However located, and in whatever form, the indicia will distinctively identify different blocks and will code those blocks to any printed instructions provided for the construction toy set.

Preferably, the adapter rods, in any of the described alternatives, are separate from and removably inserted into the adapter blocks. However, it is also conceptually consistent with certain aspects of the invention to form adapter blocks with one or more adapter rods integrally molded as a fixed element of the block.

In any of its embodiments, the system of the invention serves to greatly enlarge the usability and attractiveness of construction toy sets. For the existing base of standard K'NEX rod and connector sets, building blocks and adapter blocks and rods can be provided to enable free interfacing from one construction style to the other. The user has virtually endless possibilities for making hybrid constructions involving block elements in conjunction with rod and connector features.

For the existing base of Lego, Mega Bloks and Duplo construction sets, rod and connector sets are scaled and dimensioned for compatibility with the existing blocks and are provided with adapter blocks and adapter rods to allow the user to interface between rod and connector structure and block structure, on a simple and facile basis.

For existing K'NEX sets, both of the standard type and the KID K'NEX type, block sets can be included or provided, in each case including both adapter blocks and adapter rods as described herein. The block sets are dimensioned for compatibility with the existing K'NEX and KID K'NEX sets and provide the user with a high degree of freedom in the assemblies of a limitless variety of hybrid structures. It is also contemplated, of course, that the builder may choose to make structures entirely of the block type or entirely of the rod and connector type, as well as hybrid structures.

In all versions of the invention, whether adapting to the existing base of block-type construction sets or to the existing base of K'NEX and KID K'NEX sets, the design of the adapter blocks is such as to accommodate the joining of rod and connector structures with block structures on a basis accommodating both transverse and longitudinal orientation of the rods, and also diagonal (45 degree) orientation of the rods. The arrangement is such that right triangular structures, which are fundamental to the K'NEX construction sets, can be readily constructed on a base of block-type building units. In this connection, the block-type building units can be of virtually any size and shape, as long as the spacing of the studs and adapter recesses is consistent with the principles of the invention.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

The invention claimed is:

1. A multi-part construction toy set accommodating the building of hybrid structures including rod and connector type substructures joined with block type substructures and which includes (a) a plurality of connector elements formed of plastic material and comprising a hub-like section and a plurality of socket-forming sections extending radially from said hub-like section, (b) said socket-forming sections each comprising a pair of spaced-apart gripping arms symmetrically arranged with respect to a socket axis extending from and perpendicular to a hub axis extending through said hub-like section, (c) said gripping arms having opposed surfaces for gripping a rod element in alignment with the socket axis and having abutment surfaces restricting axial movement of a rod element engaged by said gripping arms, (d) a plurality of rod elements each having rod end portions comprised of an end flange and a neck portion adjacent to said end flange and of smaller diameter than said end flange, and said rod end portions being receivable by lateral snap-fit insertion into said socket-forming sections to enable multi-part rod and connector assemblies to be constructed, (e) said plurality of connector elements each being formed with said socket-forming sections positioned a predetermined distance "D" from the hub axes thereof which said distance "D" is common to each connector element, (f) said rod elements being provided in a progression of "n" rods $L_1, L_2 \ldots L_n$ of progressively greater lengths such that, in a right triangular assembly of three connector elements, in which two rod elements form sides and one rod element forms a hypotenuse, the rod element forming the hypotenuse comprises the next longer length in the progression, (g) a plurality of building block elements formed of plastic material and of rectangular configuration and each having a generally flat, rectangular top wall and generally flat, rectangular side and end walls joined with edges of said top wall and defining a generally open bottom, (h) a plurality of pairs of generally cylindrical studs projecting upward from said top wall, said studs being uniformly spaced laterally and longitudinally of said top wall and positioned to have frictional internal engagement within the open bottom of a similar block positioned above to enable multi-block assemblies to be constructed, characterized by (i) said building block elements including one or more adapter blocks to enable fixed position interconnection between block assemblies and rod and connector assemblies, (j) said adapter blocks being of generally rectangular configuration and including a plurality of pairs of studs having uniform spacing laterally and longitudinally, closely corresponding to the spacing of studs of other building block elements, (k) said adapter blocks being of a shape and of external dimensions corresponding to said building block elements and each being formed with one or more vertically oriented adapter sockets uniformly spaced from adjacent pairs of studs projecting upward from said top wall, (l) said adapter sockets including tubular sleeves open at said top wall and extending downwardly therefrom, (m) said construction toy set including one or more adapter rods each including a stem portion receivable within and closely confined in fixed position by said tubular sleeves for rigidly supporting said adapter rods in said adapter blocks, (n) said adapter rods each including a rod end portion, adjacent to said stem portion, arranged to project vertically upward from said adapter block, (o) said adapter rod end portions corresponding in size and shape to rod end portions of said rod elements and adapted for lateral snap-in engagement with one of said connector elements to join said one of said connector elements interlockingly to said adapter block, (p) the transverse spacing between adapter sockets of an adapter block, and between adapter sockets of a plurality of adapter blocks positioned in laterally and/or longitudinally adjacent contact, being a combined function of two times the predetermined distance "D" and the lengths $L_1$ $L_2$ . . . $L_n$ of said rod elements, such that an assembly of a selected rod element joined with a connector element at each end thereof, can be joined with a pair of spaced-apart adapter rods inserted in a pair of spaced-apart adapter sockets in said adapter blocks, whether said adapter sockets are aligned, longitudinally, transversely or diagonally, and (q) at least certain of said rod elements being of a length to extend a distance from one adapter block to a second adapter block positioned adjacent to or spaced from said one adapter block.

2. The construction toy set of claim 1, wherein (a) said adapter blocks have side and end walls of a predetermined height, with lower end edges thereof defining a base plane parallel to the top wall thereof, (b) said tubular sleeves extending from the top wall to a level near said base plane, and (c) said adapter rods being formed with abutment surfaces between the stem and rod end portions thereof, (d) said abutment surfaces being alternatively engageable with the top wall of said adapter block or a lower end extremity of a tubular sleeve, to position the rod end portion of said adapter rod in a predetermined position with respect to said top wall or said base plane.

3. The construction toy set of claim 1, wherein (a) at least certain of said adapter blocks have a length dimension equal to the distance between hub axes of two connector elements when joined by a rod element having a length $L_x$, where "x" is a whole number from 1 to n.

4. The construction toy set of claim 3, wherein (a) said adapter blocks have a length of substantially 1.252 inch, characteristic of a standard existing building block of known specifications, (b) said rod element of the length $L_x$ has a length of substantially 0.780 inch, and (c) said predetermined distance "D" is substantially 0.240 inch.

5. The construction toy of claim 4, wherein (a) said adapter blocks have a width dimension of substantially 0.622 inch and are formed with four spaced pairs of studs of substantially 0.1925 inch diameter, spaced longitudinally at substantially 0.315 inch center to center, with the studs of each pair being spaced substantially 0.315 inch laterally, and (b) said adapter blocks are formed with three of said adapter sockets positioned symmetrically with respect to said four spaced pairs of studs.

6. The construction toy of claim 1, wherein (a) said tubular sleeves have annular recesses at upper and lower end extremities thereof, (b) the stem portions of said adapter rods are of substantially the same length as said tubular sleeves and are receivable in said tubular sleeves from either end thereof, (c) said stem portions are provided with outwardly projecting detent means an a free end extremity thereof engageable with one of said annular recesses to secure said adapter rod in assembled position with said adapter block, and (d) said adapter rods are formed with an abutment surface at an end of said stem portion opposite to said detent means for positioning said adapter rods with respect to said adapter blocks.

7. The adapter combination according to claim 1, wherein (a) said adapter rod includes a neck portion of reduced diameter, an end flange portion, and a collar flange portion between said neck and stem portions arranged to seat against said adapter block when said stem portion is inserted into said tubular sleeve.

8. The adapter combination according to claim 7, wherein (a) said collar flange defines an end of said neck portion opposite to said end flange portion, and (b) said connector elements are formed of soft and pliable material and include rod engaging socket portions of such material, (c) said socket portions including opposed gripping jaws for gripping said adapter rod by its neck portion, between said end flange portion and said collar flange.

9. The adapter combination according to claim 8, wherein (a) radially outer portions of said gripping jaws substantially abut said collar flange.

10. The construction toy of claim 1, wherein (a) said adapter blocks are of a size to include at least four pairs of studs and at least three adapter sockets positioned uniformly between adjacent pairs of studs, (b) said adapter blocks are of rectangular configuration and have side walls and end walls extending from said top wall, and (c) said adapter sockets are spaced and positioned such that the distance between a center of an adapter socket and an adjacent side or end wall of a block substantially equals the distance between centers of adjacent adapter sockets on said block, whereby, in an assembly of laterally and/or longitudinally contacting adapter blocks, the spacing of adapter sockets remains consistent over the full extent of such assembly.

11. The construction toy of claim 1, wherein (a) said adapter blocks are marked with numerical indicia characteristic of the size and shape of the block to facilitate correlating individual blocks with building instructions associated with the construction set.

* * * * *